US009118131B2

(12) United States Patent
Jakoplic et al.

(10) Patent No.: US 9,118,131 B2
(45) Date of Patent: Aug. 25, 2015

(54) ELECTRICAL TERMINAL

(71) Applicant: YAZAKI EUROPE LTD., Hertfordshire (GB)

(72) Inventors: Ivica Jakoplic, Krapinkske Toplice (HR); Josip Jelak, Krizevci (HR)

(73) Assignee: YAZAKI EUROPE LTD., Hertfordshire (GB)

( * ) Notice: Subject to any disclaimer, the term of this patent is extended or adjusted under 35 U.S.C. 154(b) by 153 days.

(21) Appl. No.: 13/765,173

(22) Filed: Feb. 12, 2013

(65) Prior Publication Data

US 2013/0273790 A1 Oct. 17, 2013

(30) Foreign Application Priority Data

Apr. 12, 2012 (EP) ..... 12163840

(51) Int. Cl.

| | |
|---|---|
| ***H01R 13/432*** | (2006.01) |
| ***H01R 13/17*** | (2006.01) |
| ***H01R 13/11*** | (2006.01) |
| ***H01R 13/193*** | (2006.01) |
| *H01R 4/18* | (2006.01) |
| *H01R 43/16* | (2006.01) |

(52) U.S. Cl.

CPC ..... *H01R 13/17* (2013.01); *H01R 13/113* (2013.01); *H01R 13/193* (2013.01); *H01R 4/185* (2013.01); *H01R 43/16* (2013.01)

(58) Field of Classification Search

CPC . H01R 13/2442; H01R 13/187; H01R 13/432
USPC ..... 439/852–877
See application file for complete search history.

(56) References Cited

U.S. PATENT DOCUMENTS

| | | | | |
|---|---|---|---|---|
| 5,951,336 | A * | 9/1999 | Seko et al. | 439/745 |
| 6,106,339 | A * | 8/2000 | Nagai | 439/748 |
| 7,530,859 | B2 * | 5/2009 | Moll et al. | 439/852 |
| 7,811,140 | B2 * | 10/2010 | Tabata et al. | 439/877 |
| 7,976,351 | B2 * | 7/2011 | Boemmel et al. | 439/748 |
| 2008/0070452 | A1 | 3/2008 | Komiyama et al. | |
| 2008/0280510 | A1 * | 11/2008 | Moll et al. | 439/877 |
| 2010/0197177 | A1 * | 8/2010 | Myer et al. | 439/852 |

FOREIGN PATENT DOCUMENTS

| | | | |
|---|---|---|---|
| DE | 197 45 532 | A1 | 4/1998 |
| EP | 1 617 521 | B1 | 9/2010 |
| JP | 10134870 | A | 5/1998 |
| JP | 2006-54166 | A | 2/2006 |
| JP | 2008-123720 | A | 5/2008 |
| JP | 2011-154944 | A | 8/2011 |

OTHER PUBLICATIONS

Communication dated May 21, 2014, issued by the European Patent Office in counterpart European application No. 12163840.7.

* cited by examiner

*Primary Examiner* — Truc Nguyen
(74) *Attorney, Agent, or Firm* — Sughrue Mion, PLLC

(57) ABSTRACT

An electric terminal (1) made of sheet metal having a contact portion (3) including a top wall (7), a bottom wall (8), a first side wall (9) and a second side wall (10) and a contact spring arm (6) having: a contact beam (14) for achieving an electric contact with a complementary contact element and being integrally connected to the top wall (7) and a reinforcement beam (15), wherein the contact beam (14) and the reinforcement beam (15) together form an L-shaped cross-section, wherein the reinforcement beam (15) is only connected to the contact beam (14).

8 Claims, 3 Drawing Sheets

ELECTRICAL TERMINAL

FIELD OF THE INVENTION

The present invention relates to an electric terminal made of sheet metal having a contact portion comprising a top wall, a bottom wall, a first side wall and a second side wall. The contact portion further comprises a contact spring arm having a contact beam for achieving an electric contact with a complimentary contact element and being integrally connected to the top wall. The contact spring arm further has a reinforcement beam, wherein the contact beam and the reinforcement beam together form an L-shaped cross-section.

BACKGROUND OF THE INVENTION

Such an electric terminal is, for instance, known from EP 1 617 521 B1. The contact beam and the reinforcement beam are orientated perpendicular relative to each other achieving the L-shaped cross-section of the spring arm. The reinforcement beam is only connected to the contact beam at a tip end of the contact spring arm. At an opposite side of the tip end and of the contact spring arm the reinforcement wall is connected to one of the side walls of the contact portion. The contact beam is connected to the top wall of the contact portion. The contact beam and the reinforcement beam are only connected to each other at the tip end of the contact spring arm and are not connected to each other in the area of the further extension of the contact spring arm. This, however, limits the contact force which can be applied from the contact spring arm on a complimentary contact element.

DE 197 45 532 A1 also discloses an electric terminal as mentioned above. The contact spring arm also has an L-shaped cross-section having a contact beam and a reinforcement beam. The contact beam is connected to the top wall and the reinforcement beam to one of the side walls of the contact portion. The reinforcement beam is connected to the contact beam integrally and reaches over almost the entire length of the contact beam. The reinforcement beam, however, does not reach to the tip end of the contact beam. The tip end of the contact beam is bent upwardly in direction towards the top wall in order to form a contact point to be brought into contact with a complimentary contact element. The upwardly bent tip end of the contact beam can only be manufactured if in this region the contact beam does not have an L-shaped cross-section. Further, the complete contact spring arm is inclined towards the bottom wall and is, except for the tip end of the contact spring arm, linear, i.e. not bent.

It is the object of the present invention to provide an electric terminal which can be easily manufactured and which provides a high contact force of the contact spring arm.

SUMMARY OF THE INVENTION

The object is achieved by an electric terminal described below. Advantageous embodiments are described in the dependent claims.

According to the invention the reinforcement beam is only connected to the contact beam of the contact spring arm. This means that the reinforcement beam is not connected to anyone of the walls of the contact portion. The contact spring arm is only connected via the contact beam to the top wall of the contact portion. Due to the fact that the reinforcement portion is not connected to one of the walls of the contact portion the contact spring arm can be manufactured by a bending process much easier. In the longitudinal direction of the contact spring arm, i. e. from the connection between the contact beam and the top wall portion to an opposite tip end of the contact spring arm, the contact spring arm can be bent towards the bottom wall. During such a bending procedure the reinforcement wall is deformed within the plane of the sheet metal material of the reinforcement wall. Since the reinforcement wall is not connected to one of the side walls it can be freely deformed and any wrinkles are avoided because the material can deform also at the longitudinal ends of the reinforcement wall in order to decrease internal stresses.

The reinforcement wall can be orientated parallel or planar to the first side wall and can be integral with the contact beam. In order to provide for an easy manufacturing and to avoid material waste the reinforcement beam is cut out off the first side wall.

The contact spring arm can comprise a base portion being connected to a wall portion of the top wall and being planar to this wall portion. The contact spring arm further comprises an end portion being integral with the base portion and extending at an inclination towards the bottom wall. The inclined end portion of the contact spring arm is, thus, shorter than the entire length of the contact spring arm so that basically the end portion will be deflected when the electric terminal is connected to a complimentary contact element. Due to the fact that only a shorter part of the contact spring arm is deflected during insertion of a complimentary contact element the overall contact force of the contact spring arm which is biasing the complimentary contact element is increased.

In a further advantageous embodiment the reinforcement wall extends over adjoining areas of the base portion and the end portion, therefore, further enforcing the contact spring arm to increase the contact force.

Further, the base portion is supported by the top wall so that the base portion is also supported against a deflection increasing the contact force.

The contact portion of the electric terminal is basically box-shaped. The top wall can be made of three layers of sheet metal. An inner layer is integrally connected to the contact beam of the contact spring arm. An intermediate layer is at least partially in supporting contact to the contact spring arm, in particular to the base portion of the contact spring arm. An upper layer forms a recess for a locking member of a connector housing providing a primary locking feature to hold the electric terminal within a cavity of the connector housing.

The inner layer of the upper wall is integral with the first side wall and is bent inwardly. The intermediate layer is integral with the second side wall and is parallel to the inner layer and also bent inwardly. The upper layer is integral with the intermediate layer and is bent in the form of a fold overlying the intermediate layer. In particular, the complete electric terminal is made of one sheet metal part.

BRIEF DESCRIPTION OF THE DRAWINGS

A preferred embodiment of an electric terminal will now be described by way of example with respect to the Figures.

DETAILED DESCRIPTION OF THE INVENTION

Figure 1:
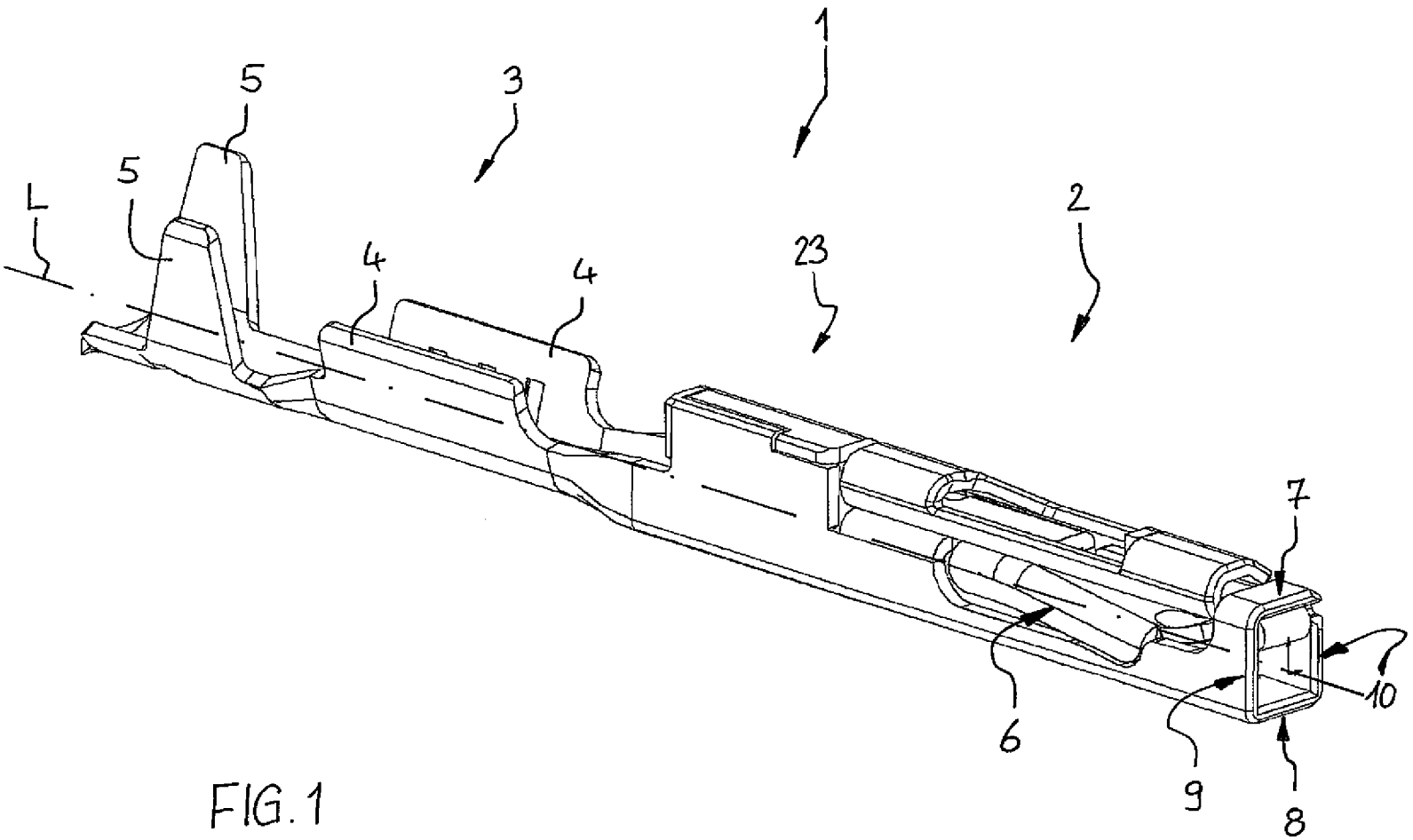
FIG. 1 is a perspective view of an electric terminal.

FIG. 1 shows a perspective view of an electric terminal 1 having a contact portion 2 and a connection portion 3.

Between the connection portion 3 and the contact portion 2 there is provided a body portion 23. The electric terminal 1 is as a whole manufactured from a sheet-metal part by means of bending wherein the sheet metal part is made from an electrical conductive material, such as copper or a copper alloy. The connection portion 3 comprises two first crimping taps 4 for connecting an electrical conductor of a cable (not shown) to the electric terminal 1 by means of crimping. Furthermore, two second crimping taps 5 are provided on the side of the first crimping taps 4 which is opposite to the contact portion 2. The two second crimping taps 5 can be crimped to an insulation of the afore-mentioned cable.

The contact portion 2 has a box shape with a hollow rectangular profile, wherein at an end thereof, which is facing away from the connection portion 3, a contact spring arm 6 is provided. The contact spring arm 6 is formed elastically and serves to accommodate and to contact a contact pin or contact blade of a complimentary contact element and thereby achieving an electrically conductive connection.

Figure 2:
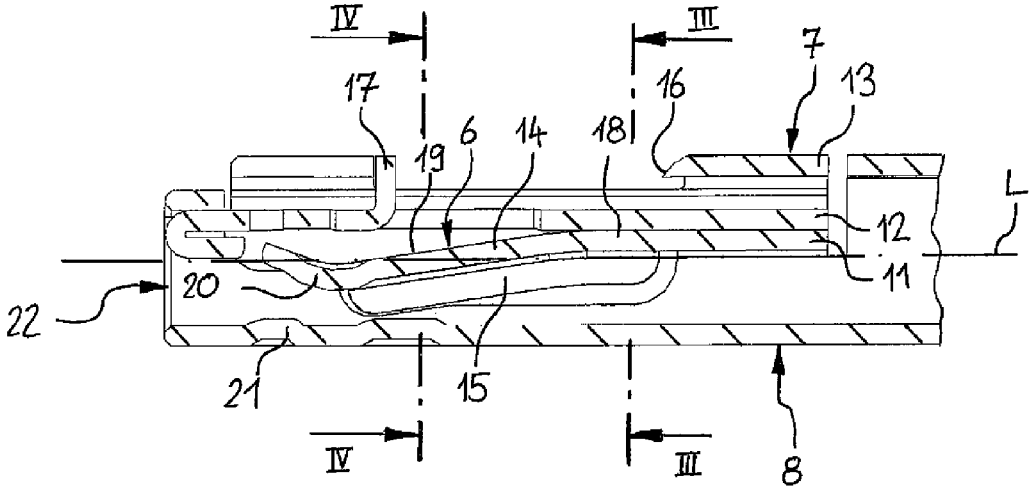
FIG. 2 is a longitudinal section of the contact portion of the electric terminal according to FIG. 1.
Figure 3:
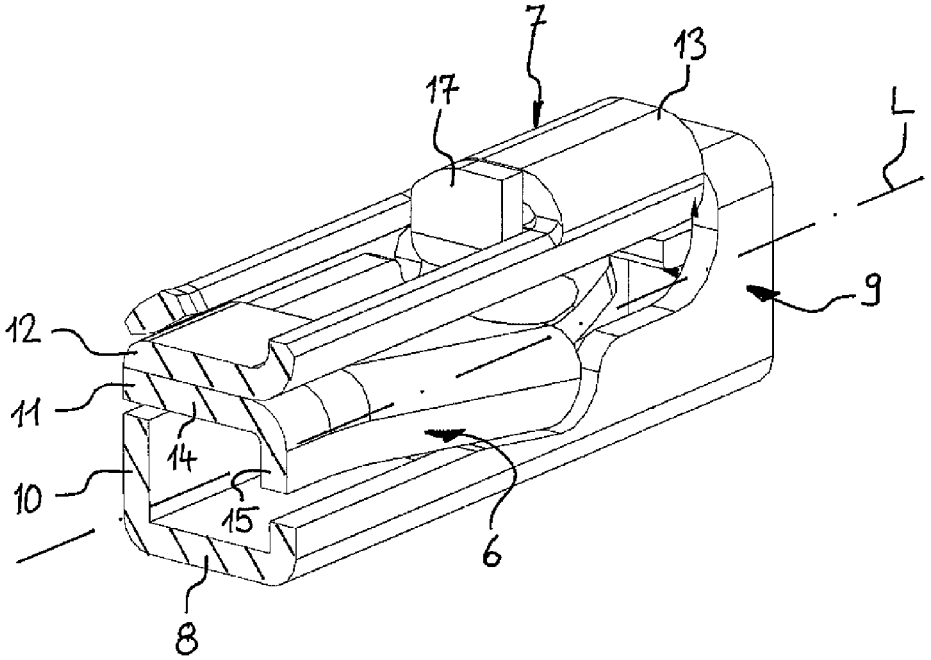
FIG. 3 is a cross-section view according to line III-III of FIG. 2 in a perspective view.
Figure 4:
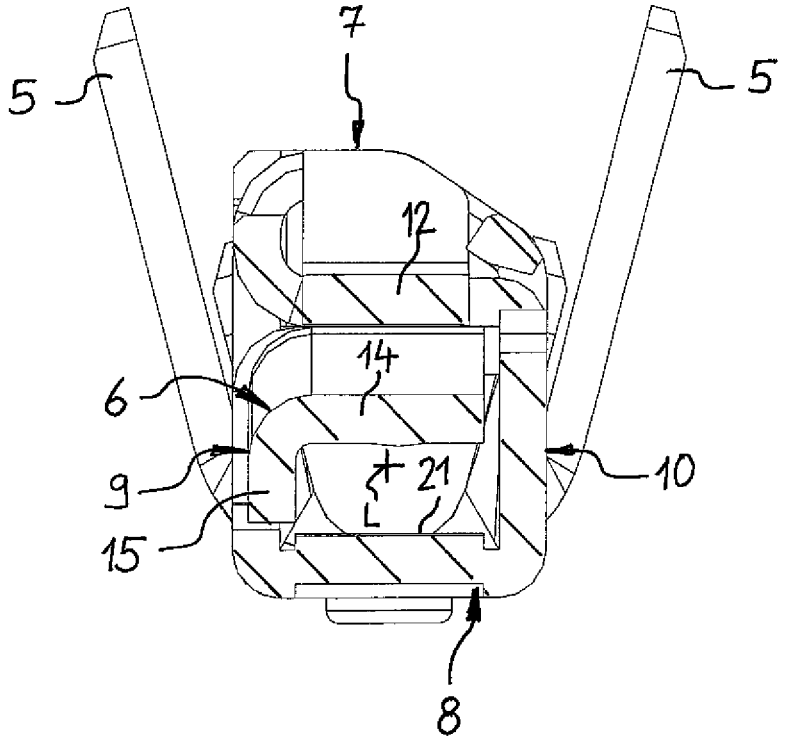
FIG. 4 is a cross-section view of the contact portion along the line IV-IV of FIG. 2.

The contact portion 2 is now described in more detail also with reference to FIGS. 2, 3 and 4. The contact portion 2 is box-shaped and has a top wall 7, a bottom wall 8, a first side wall 9 and a second side wall 10. The walls 7, 8, 9, 10 together have a hollow rectangular cross-section extending along a longitudinal axis L of the electric terminal 1.

The top wall is made in a three layer design made of three layers of the sheet-metal material. The top wall 7 has an inner layer 11, an intermediate layer 12 and an upper layer 13, wherein the intermediate layer 12 is arranged between the inner layer 11 and the upper layer 13. The inner layer 11 is integrally connected to the contact spring arm 6. The intermediate layer 12 is along a part of the length of the contact spring arm 6 in supporting contact to the contact spring arm 6 for increasing a contact force as described later. The upper layer 13 is provided with a recess 16 for a locking member of a connector housing. When mounting the electric terminal 1 into a cavity of a connector housing (not shown) a primary locking arm resiliently held within the cavity of the connector housing can enter the recess 16. The intermediate layer 12 is provided with a support lug 17 which is bent outwardly into the recess 16 and supported against an edge of the recess 16. When pulling-out forces are acting on the electric terminal 1 the primary locking arm of the connector housing can abut the support lug 17 in order to avoid that the electric terminal 1 can be pulled-out of the cavity of the connector housing.

The contact spring arm 6 has an L-shaped cross-section as can be best seen from FIGS. 3 and 4. The contact spring arm 6 comprises a contact beam 14 which is integrally connected to the inner layer 11, i. e. the contact beam 14 is actually cut out of the inner layer 11. The contact beam 14 comprises a base portion 18 and an end portion 19 wherein the base portion 18 is connected to the inner layer 11. The base portion 18 is adjoined by the end portion 19 with a tip end 20. The base portion 18 is parallel to the intermediate layer 12 and planar to the inner layer 11 and is in supporting contact to the intermediate layer 12. The end portion 19 extends from the base portion 18 at an inclination towards the bottom wall wherein the tip end 20 is bent upward in direction towards the top wall 7. The tip end 20 faces an opening 22 of the contact portion 2 through which a contact pin (not shown) of a complimentary element can be inserted into the electric terminal 1. This pin will enter the electric terminal 1 and more particularly the contact portion 2 between the contact spring arm 6 and the bottom wall 8. During the insertion of the contact pin the contact spring arm 6 will be deflected upwardly towards the op wall 7 and applying force onto the contact pin in direction to the bottom wall 8. The bottom wall 8 comprises a contact support 21 in form of two embossings which are projecting inwardly towards the top wall 7. The contact force of the contact spring arm 6 is increased compared to contact spring arms according to the prior art in that the base portion 18 of the contact spring arm 6 is supported by the intermediate layer 12. A further feature for increasing the contact force is that the contact spring arm 6 is provided with a reinforcement beam 15 which extends over a part of the length of the contact spring arm 6. The reinforcement beam 15 and the contact beam 14 are arranged perpendicular to each other so that in the area of the reinforcement beam 15 the contact spring arm 6 has an L-shaped cross-section. However, the contact beam 14 and the reinforcement beam 15 do not need to be arranged perpendicular to each other. It is sufficient if the reinforcement beam 15 is arranged angled to the contact beam 14. The reinforcement beam 15 is arranged parallel to the first side wall 9 and is cut out of the first side wall 9. However, the reinforcement beam 15 is not connected to the side wall. The reinforcement beam 15 is only integrally connected to the contact beam 14. This makes it easier to manufacture the contact spring arm 6, in particular because the contact spring arm 6 is bent between the base portion 18 and the end portion 19. Due to the fact that the contact spring arm 6 is bent in a direction of the plane of the reinforcement beam 15 any wrinkles are avoided by the fact that the reinforcement beam 15 is not connected to the first side wall 9.

The contact force is directed parallel to the plane of the reinforcement beam 15 so that the reinforcement beam 15 efficiently increases the contact force.

REFERENCE LIST

1 electric terminal
2 contact portion
3 connection portion
4 first crimping tab
5 second crimping tap
6 contact spring arm
7 top wall
8 bottom wall
9 first side wall
10 second side wall
11 inner layer
12 intermediate layer
13 upper layer
14 contact beam
15 reinforcement beam
16 recess
17 support lug
18 base portion
19 end portion
20 tip end
21 contact support
22 opening
23 body portion
L longitudinal axis

The invention claimed is:

1. An electric terminal made of sheet metal having a contact portion, comprising a top wall, a bottom wall, a first side wall and a second side wall and a contact spring arm having:

a contact beam for achieving an electric contact with a complementary contact element and being integrally connected to the top wall and a reinforcement beam, wherein the contact beam and the reinforcement beam together form an L-shaped cross-section, wherein the reinforcement beam is integrally connected only to the contact beam, and wherein the top wall is made of three layers of sheet metal, an inner layer, integrally connected to the contact beam of the contact spring arm, an intermediate layer, at least partially in supporting contact to the contact spring arm, and an upper layer, forming a recess for a locking member of a connector housing.

2. The electric terminal according to claim 1, wherein the reinforcement beam is parallel or planar to the first side wall and is integral with the contact beam.

3. The electric terminal according to claim 1, wherein the reinforcement beam is cut out off the first side wall.

4. The electric terminal according to claim 1, wherein the contact spring arm comprises a base portion being connected to the top wall and that the contact spring arm further comprises an end portion being integral with the base portion and extending at an inclination towards the bottom wall.

5. The electric terminal according to claim 4, wherein the reinforcement wall extends over adjoining areas of the base portion and the end portion.

6. The electric terminal according to claim 1, wherein the inner layer of the top wall is integral with the first side wall and is bent inwardly.

7. The electric terminal according to claim 1, wherein the intermediate layer is integral with the second side wall and is parallel to the inner layer.

8. The electric terminal according to claim 1, wherein the upper layer is integral with the intermediate layer and is bent in the form of a fold overlying the intermediate layer.

* * * * *